US009826820B2

(12) United States Patent
Slovis

(10) Patent No.: US 9,826,820 B2
(45) Date of Patent: Nov. 28, 2017

(54) HANDLE FOR A CONTAINER

(71) Applicant: Adam J. Slovis, Memphis, TN (US)

(72) Inventor: Adam J. Slovis, Memphis, TN (US)

( * ) Notice: Subject to any disclaimer, the term of this patent is extended or adjusted under 35 U.S.C. 154(b) by 195 days.

(21) Appl. No.: 14/846,430

(22) Filed: Sep. 4, 2015

(65) Prior Publication Data

US 2017/0066557 A1 Mar. 9, 2017

(51) Int. Cl.

| | |
|---|---|
| ***B65D 25/04*** | (2006.01) |
| ***A45F 5/10*** | (2006.01) |
| ***A45C 13/26*** | (2006.01) |
| ***A45C 13/30*** | (2006.01) |
| ***B65D 25/28*** | (2006.01) |
| *A45C 13/22* | (2006.01) |

(52) U.S. Cl.

CPC ..... *A45F 5/10* (2013.01); *A45C 13/26* (2013.01); *A45C 13/30* (2013.01); *A45F 5/102* (2013.01); *B65D 25/2873* (2013.01); *A45C 2013/223* (2013.01); *A45F 2200/0566* (2013.01)

(58) Field of Classification Search

CPC .. B65D 25/28; B65D 25/287; B65D 25/2876; B65D 39/16; B65D 51/242; B65D 25/02; B65D 25/106; B65D 5/326; B65D 25/2873; B65D 25/2867; A45F 5/10; A45F 5/102; A45F 2000/0566; Y10T 16/44; Y10T 16/451; Y10T 16/4554; A45C 13/30; A45C 13/22; A45C 13/26; A45C 13/28; A45C 2013/223; A01K 97/08; A41F 9/002; A41F 9/005; A41F 15/00

USPC ..... 220/528, 604, 752, 754, 759, 761, 762, 220/763, 764, 767, 768, 769, 770, 771, 220/522, 521, 212, 676, 229, 212.5, 756; 2/311–322; 16/428, 425, 422, 405, 406, 16/114.1; 190/117, 116, 115

See application file for complete search history.

(56) References Cited

U.S. PATENT DOCUMENTS

| | | | | |
|---|---|---|---|---|
| 2,645,407 A | | 7/1953 | Bergstein | |
| 3,127,011 A | * | 3/1964 | Weddle | B65D 11/02 206/423 |
| 3,550,834 A | | 12/1970 | Mccall | |
| 3,621,991 A | | 11/1971 | Richter | |

(Continued)

FOREIGN PATENT DOCUMENTS

FR 2901540 B1 10/2010

*Primary Examiner* — J. Gregory Pickett
*Assistant Examiner* — James M Van Buskirk
(74) *Attorney, Agent, or Firm* — Veritay Group, IP; Susan Fentress

(57) ABSTRACT

This invention in provides an a method to attach a handle to a generally rounded shipping container by attaching each end of a handle to opposite ends of a generally rounded shipping container to form a handle assembly made of a plurality of end cap units, each of the plurality of end cap units having an internal partition with a slit configured to retain a buckle, wherein the buckle is connected to a handle. This invention also provides an assembly made of plurality of retaining tabs each with a slit configured to retain one side of a handle and the handle connected to said plurality of retaining tabs and a plurality caps configured to retain said plurality of retaining tabs to affix a handle to said shipping container. The assembly, in an exemplary embodiment, can include a retaining tab made of a plurality of generally flat first retaining element and generally flat second retaining element.

4 Claims, 4 Drawing Sheets

(56) References Cited

U.S. PATENT DOCUMENTS

| | | | | |
|---|---|---|---|---|
| 3,952,869 | A * | 4/1976 | Sansom | A61L 2/26 206/363 |
| 4,637,544 | A | 1/1987 | Quercetti | |
| 4,817,866 | A | 4/1989 | Wonnacott | |
| 5,133,290 | A | 7/1992 | Marco et al. | |
| 5,899,377 | A | 5/1999 | Speese et al. | |
| 6,318,612 | B1 * | 11/2001 | MacNeil | B60R 9/048 224/330 |
| 6,758,337 | B2 | 7/2004 | Chargueraud et al. | |
| 7,204,405 | B2 | 4/2007 | Johnson | |
| 7,419,053 | B2 | 9/2008 | Silverbrook et al. | |
| 7,484,652 | B2 | 2/2009 | Kalberer | |
| 7,644,832 | B1 * | 1/2010 | Tsengas | B65D 43/0208 220/212 |
| 8,397,944 | B1 | 3/2013 | Landes | |
| 8,500,944 | B2 | 8/2013 | Lawrence | |
| 2002/0121456 | A1 | 9/2002 | Mannion et al. | |
| 2011/0000956 | A1 | 1/2011 | Junge | |
| 2014/0135739 | A1 * | 5/2014 | Solomon | A61M 25/0097 604/535 |

* cited by examiner

HANDLE FOR A CONTAINER

CROSS-REFERENCE TO RELATED APPLICATIONS

Not applicable.

BACKGROUND OF THE INVENTION

Field of the Invention

This disclosure relates to an apparatus for providing a handle to a shipping container and a method to attach a handle to a shipping container.

Description of Related Art including information disclosed under 37 CFR 1.97 and 1.98.

Packaging, such as box containers, is handled by automated equipment during shipment and is designed to present smooth surfaces, without handles to the automation equipment. This configuration reduces the chance of blockage of the equipment and the concomitant delay to sort out a tangle of packages. Unfortunately this shipping requirement prevents package manufacturers from building convenient handles on their packaging.

BRIEF SUMMARY OF THE INVENTION

This invention provides an assembly made of a plurality of end cap units, each of the plurality of end cap units is sized to retain one end of a shipping container; each of the plurality of end cap units has an internal partition with a slit; wherein the plurality of end cap units are configured to attach to each other and form a cavity to retain a plurality of buckles connected to a handle, when the handle is in a coiled configuration. More specially, this invention provides a generally rounded shipping container having the plurality of end cap units attached to each end of the rounded shipping container, wherein the handle projects away from each of the plurality of end cap units, to form a closed loop to carry the container.

This invention, in another embodiment, provides an assembly made of a plurality of retaining tabs, each of the plurality of retaining tabs are made of a first flat retaining element and a second flat retaining element. The first retaining element and the second retaining element are at a right angle relative to each other, wherein the second retaining element has a slit configured to retain one side of a handle. The assembly further includes a shipping container, wherein the handle is connected to the plurality of retaining tabs and a plurality of caps are configured to retain each of the first flat retaining elements within in the shipping container, to affix the handle to the shipping container.

This invention provides a method to attach a handle to a shipping container. The steps involve attaching each end of a handle to opposite ends of the shipping container to form a handle.

In one embodiment this method includes the steps of: attaching a plurality of end cap units to the opposite ends of a shipping container, each of the plurality of end cap units having an internal partition with a slit configured to retain a buckle, wherein the buckle is connected to a handle.

In one embodiment, this method involves the steps of: providing an apparatus made of a plurality of retaining tabs, each of the plurality of retaining tabs are made of a first flat retaining element and second flat retaining element. The first retaining element and the second retaining element are at a right angle relative to each other and the second retaining element has a slit configured to retain one side of a handle; providing a shipping container; positioning the first flat retaining element for each of the plurality of retaining tabs inside of the shipping container; and positioning a cap on each end of the shipping container to retain each of the first flat retaining elements within the shipping container so as to affix the handle to the shipping container.

BRIEF DESCRIPTION OF SEVERAL VIEWS OF THE DRAWING(S)

The invention can be best understood by those having ordinary skill in the art by reference to the following detailed description when considered in conjunction with the accompanying drawings in which.

DETAILED DESCRIPTION OF THE INVENTION

Figure 1:
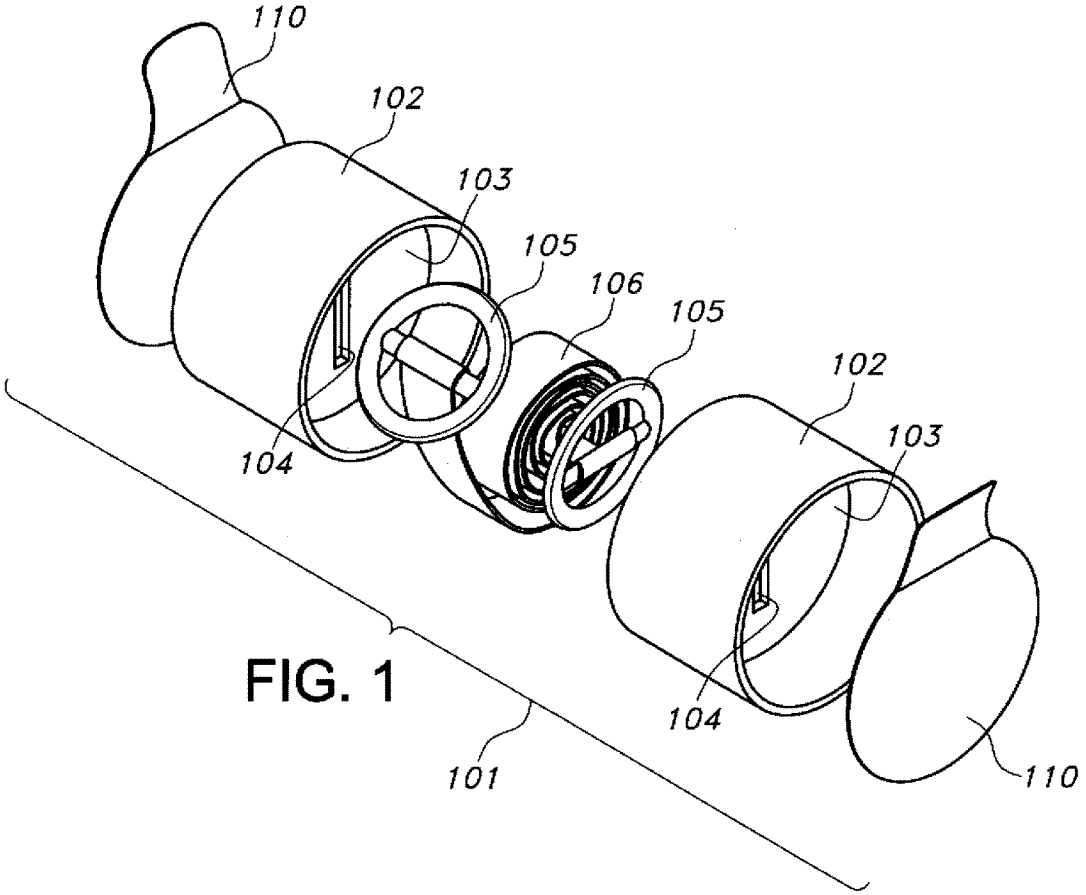
FIG. 1 illustrates an exploded isometric view of an exemplary embodiment of a handle assembly.
Figures 2, 3:
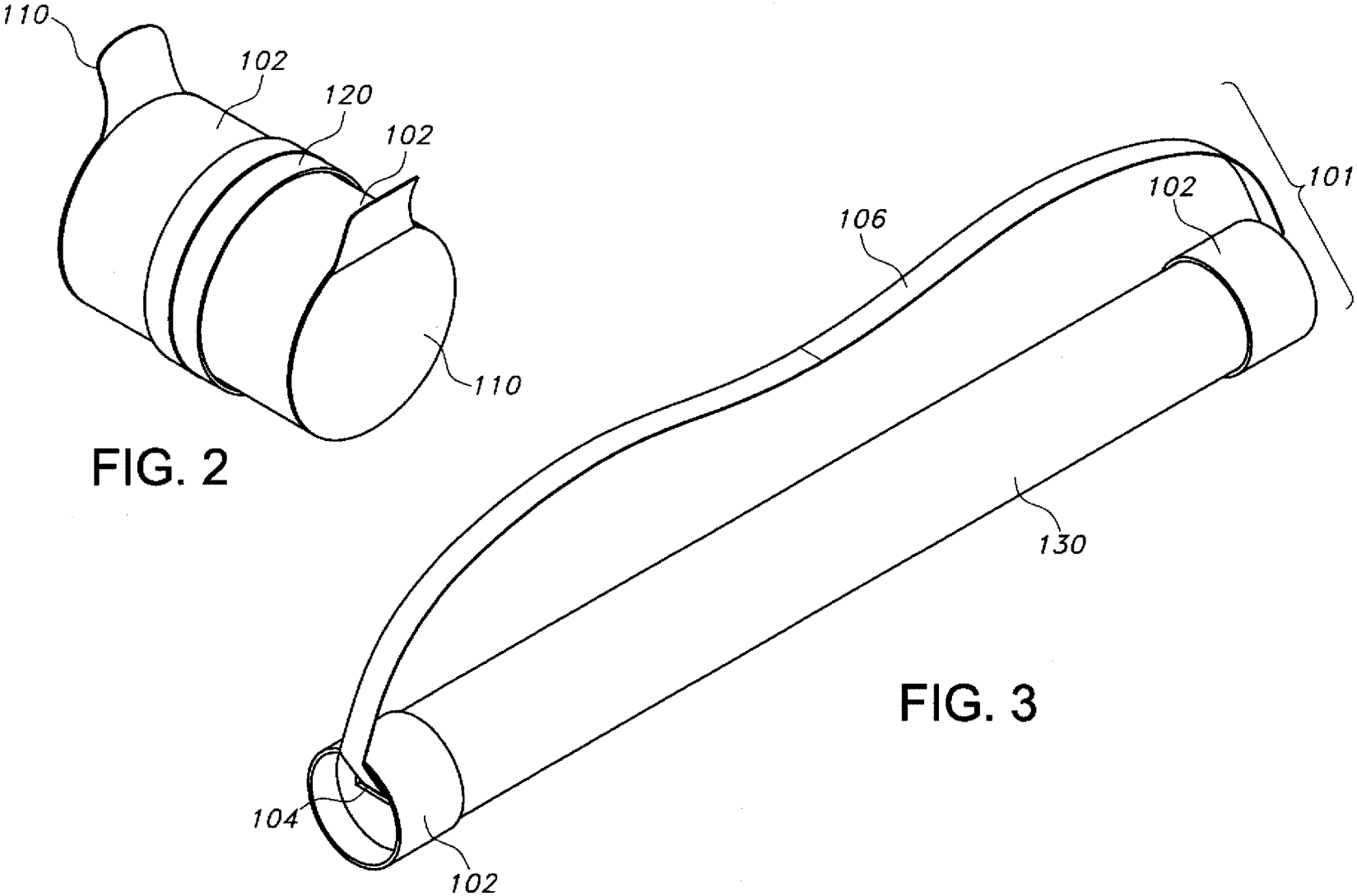
FIG. 2 illustrates a compressed isometric view of an exemplary embodiment of a handle assembly.
FIG. 3 illustrates a compressed isometric view of an exemplary embodiment of a handle assembly with a mailing container.

Now referring to FIGS. 1-2, an exploded and compressed views of an exemplary embodiment of a handle assembly 101 are shown. The handle assembly 101 includes a plurality of end cap units 102. In this exemplary embodiment, the plurality of end cap units 102 are generally round in shape and are configured to connect to a shipping container by fitting over the outside of the shipping container. For example, if a shipping container is 6 inches in diameter, each inside diameter of the plurality of end cap units 102 are slightly larger than 6 inches to fit snuggly over each end of the shipping container.

Each of the plurality of end cap units 102 have an internal partition 103 with a slit 104 configured to retain a buckle 105. A plurality of buckles 105 are connected to a handle 106. A release tab 110 is affixed to an end of each of the plurality of end cap units 102. In usage, the release tab 110 is peeled from each of the plurality of end cap units 102 to reveal the internal partition 103 with a slit 104. Each of the plurality of end cap units 102, when connected to each other form a cavity to retain the plurality of buckles 105 connected to a handle 106, when the handle 106 is in the coiled configuration.

The compressed handle assembly 101 is sealed by seal 120 projecting around the plurality of end cap units 102 to hold the plurality of end cap units 102 in the compressed form. The seal 120 in one embodiment can be a center tape.

The assembly of this invention, can be made for example from card-stock or cardboard 'F' Flute, or from a plastic, like sheet good polypropylene. The cap end units 102 can be cardboard or plastic and the handle can be cloth or film. The plurality of end cap units 102 have depth in order to engage the container in a structural manner for which the container may be filled with the weight of paper and still remain sound and secure in transport.

Now referring to FIG. 3, the handle assembly 101 is installed on a shipping container 130, such as a generally rounded tube. The plurality of end cap units 102 are generally round in shape and are configured to connect to the ends of shipping container 130. Handle 106 projects from each of the plurality of end cap units 102 and the handle 106 is retained by a plurality of buckles 105, each secured in one of the of slits 104 in the plurality of internal partitions 103.

Now referring to FIG. 4, the method of assembly is shown. In FIG. 4A, the compressed handle assembly 101 is opened by removing seal 120. In FIGS. 4B-D, the release tabs 110 are removed to show a plurality of buckles 105 connected to a handle 106. When the release tabs 110 are removed, the plurality of buckles 105 are not visible yet, until the center tape 120 is removed. Each of the plurality of buckles 105 is turned sidewise to project through one of the plurality of slits 104, and then turned to be parallel with the internal partition 103 to securely retain each of the plurality buckles in each of the plurality of slots 104.

Figure 4D:
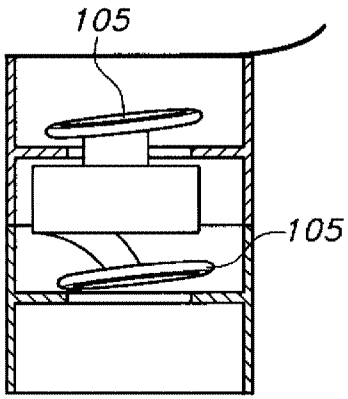
FIGS. 4A-4E illustrate various views of exemplary embodiments of a handle assembly with a mailing container.
Figure 4C:
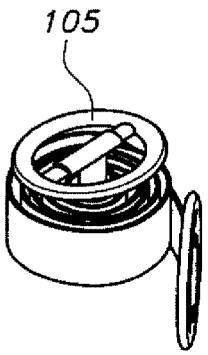
Figure 4E:
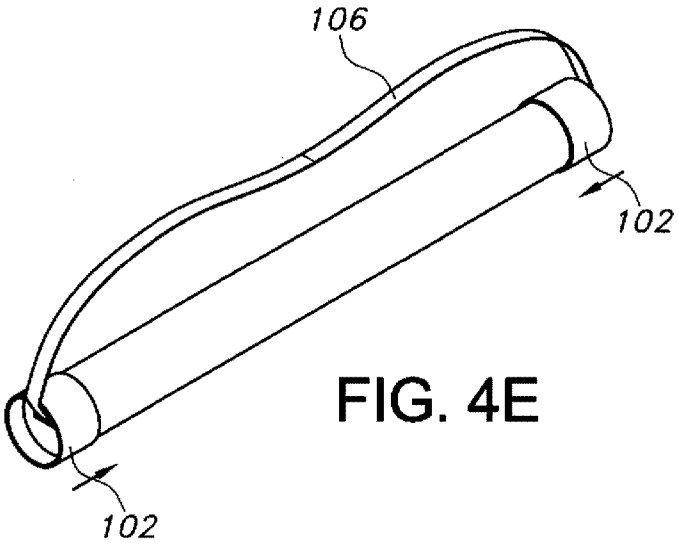
Figure 4B:
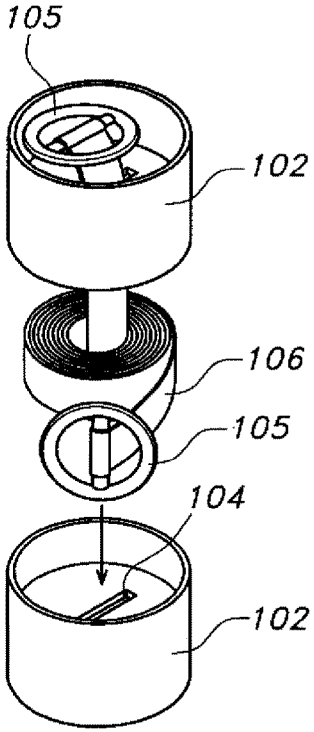
Figure 4A:
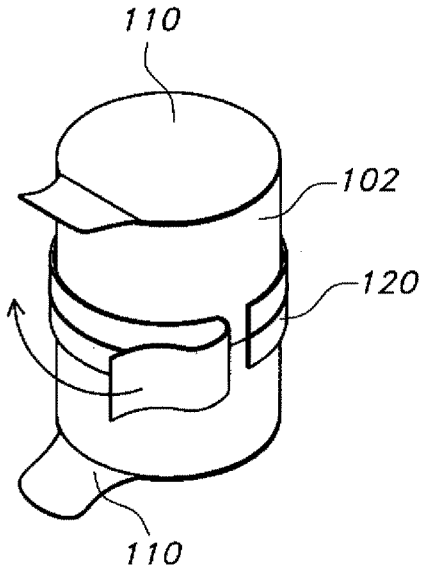

As shown in FIG. 4E, the handle 106 projects away from each of the plurality of end cap units 102, to form a closed loop to carry the container 130, when installed on the mailing container. This closed loop is achieved by connecting each of the plurality of end cap units 102 with the handle 106 projecting away from each of the plurality of end cap units 102, to form a closed loop to carry the container 130.

Figures 5A, 5B, 5C:
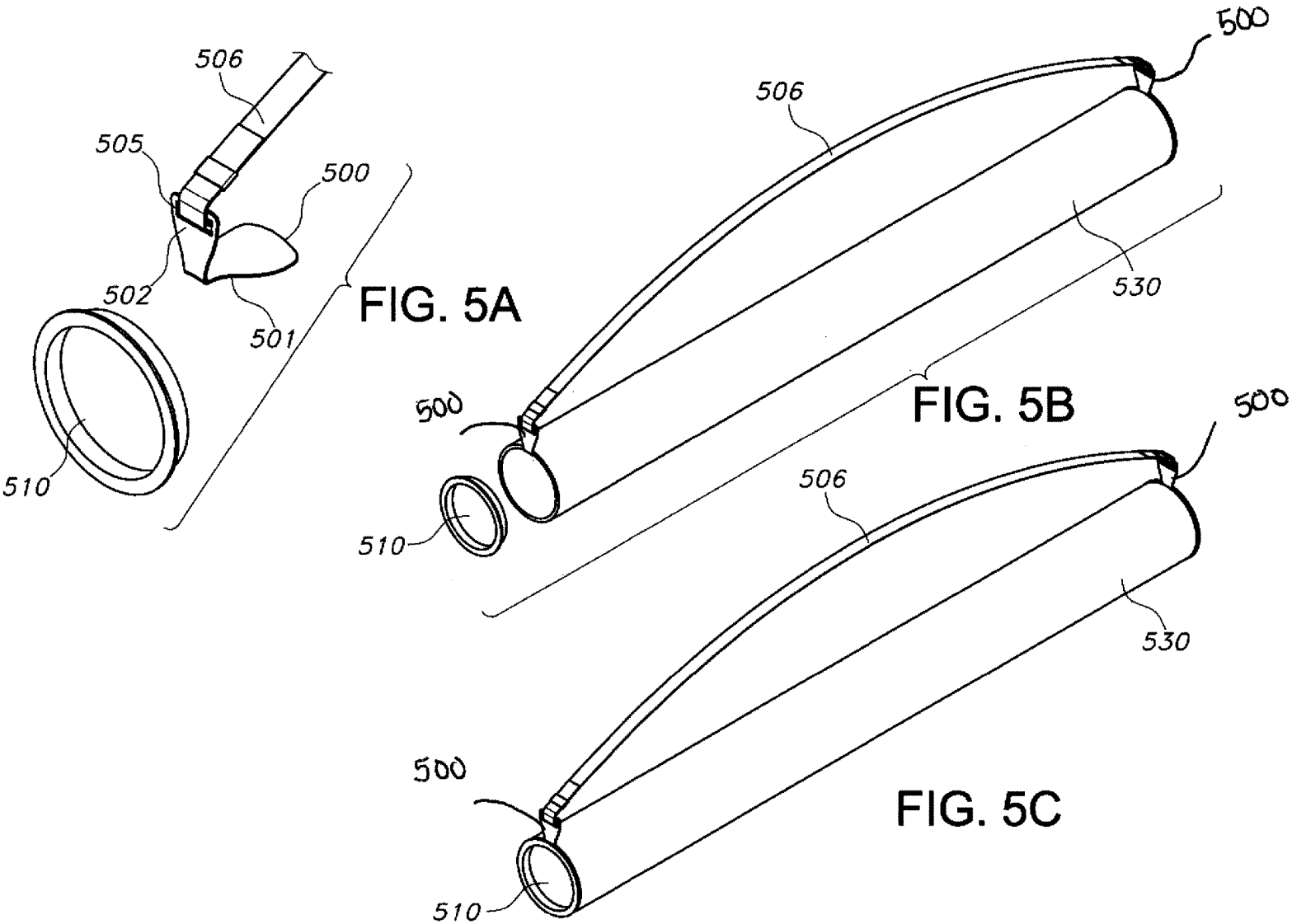
FIGS. 5A-5C illustrate various views of an exemplary embodiment of a handle assembly with a mailing container

Now referring to FIG. 5., an alternative embodiment, is shown. This embodiment provides a plurality of retaining tabs 500 to attach a handle 506. Each of the plurality of retaining tabs 500 are made of a generally flat first retaining element 501 and generally flat second retaining element 502. The first retaining element 501 and second retaining element 502 are generally at a right angle relative to each other. The second retaining element 502 has a slit 505 configured to retain one side of a handle 506.

The opposite side of the handle 506, is retained by a second retaining tab 500 that is made of a generally flat first retaining element 501 and a generally flat second retaining element 502. The first retaining element 501 and the second retaining element 502 are generally at a right angle relative to each other. The second retaining element 502 has a slit 505 configured to retain one side of a handle 506.

In use, each of the first retaining elements 501 of the plurality of retaining tabs 500 are placed into the container and a cap of a plurality of caps 510 is placed on to the end of the container 530 to secure each of the plurality of retaining tab 500 within the container 530. The shape of the retaining tab 500 can be of any shape designed by one skilled in the art to allow the plurality of caps 510 to retain the retaining tab 500.

The retaining element 500 can be made from die cut card stock, die cut plastic or stamped metal. The flat retaining element can have an adhesive strip (not shown) on one side to adhere it to the inner wall of the container. The handle can be made of paper form, TYVEK, cloth or film; static or elastic.

The present invention may be understood more readily by reference to the following detailed description of the invention. It is to be understood that this invention is not limited to the specific devices, methods, conditions or parameters described herein, and that the terminology used herein is for the purpose of describing particular embodiments by way of example only and is not intended to be limiting of the claimed invention. Also, as used in the specification containing the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value.

I claim:

1. A handle assembly for a hollow tubular shipping container said handle assembly having an attached and a detached configuration comprising:

a plurality of end cap units, each of said plurality of end cap units are comprised of an external wall and a recessed internal partition perpendicular to said external wall, said internal partition forming a first cavity and a second cavity in each of the end cap units, said internal partition having a slit configured to receive a retaining member, wherein said first cavity is configured to receive one end of the hollow tubular shipping container in the detached configuration;

a handle comprised of a strap having a first and a second end, wherein the first end and the second end each have a retaining member configured to be retained in the second cavity by the slit in the internal partition; and wherein the plurality of end cap units are in the attached configuration said plurality of end cap units are configured to attach to each other and to form a cavity to retain each of the retaining members connected to said strap and said strap when the strap is in a coded configuration.

2. The assembly of claim 1 wherein the plurality of end cap units are in the attached configuration further comprising: a release tab affixed to an end of each of the plurality of end cap units.

3. The assembly of claim 1 further comprising: a seal connecting the plurality of end cap units.

4. The assembly of claim 1, further comprising: a shipping container wherein the plurality of end cap units are attached to each end of the shipping container, wherein the strap projects away from each of the plurality of end cap units, to form a closed loop to carry the shipping container.

* * * * *